US008171895B2

(12) United States Patent
Scolton et al.

(10) Patent No.: US 8,171,895 B2
(45) Date of Patent: May 8, 2012

(54) COOLANT FLOW CONTROL SYSTEM AND METHOD

(75) Inventors: Chris J. Scolton, Chillicothe, IL (US); Douglas W. Koehler, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 550 days.

(21) Appl. No.: 12/341,331

(22) Filed: Dec. 22, 2008

(65) Prior Publication Data

US 2010/0154730 A1 Jun. 24, 2010

(51) Int. Cl.
*F01P 7/14* (2006.01)

(52) U.S. Cl. ..... 123/41.09; 123/568.2; 60/599

(58) Field of Classification Search ..... 123/41.02, 123/41.05, 41.08, 41.09, 41.1, 41.15, 41.29, 123/41.31, 196 AB, 689, 540, 542, 563, 568.12; 60/599

See application file for complete search history.

(56) References Cited

U.S. PATENT DOCUMENTS

| | | | | |
|---|---|---|---|---|
| 4,520,767 | A | 6/1985 | Roettgen | |
| 4,697,551 | A | 10/1987 | Larsen | |
| 5,201,285 | A * | 4/1993 | McTaggart | 123/41.31 |
| 5,598,705 | A | 2/1997 | Uzkan | |
| 5,669,338 | A | 9/1997 | Pribble | |
| 6,158,398 | A | 12/2000 | Betz | |
| 6,158,399 | A | 12/2000 | Ash | |
| 6,314,921 | B1 | 11/2001 | Ash | |
| 6,604,515 | B2 | 8/2003 | Marsh | |
| 6,609,484 | B2 | 8/2003 | Penn | |
| 6,857,398 | B2 * | 2/2005 | Takagi et al. | 123/41.1 |
| 2004/0065275 | A1 * | 4/2004 | Hayami et al. | 123/41.1 |
| 2004/0144340 | A1 * | 7/2004 | Kilger | 123/41.1 |
| 2009/0114170 | A1 * | 5/2009 | Dolker | 123/41.09 |

* cited by examiner

*Primary Examiner* — Marguerite McMahon
*Assistant Examiner* — Hung Q Nguyen
(74) *Attorney, Agent, or Firm* — Robin S. Fahlberg

(57) ABSTRACT

A coolant flow control system includes a fluid cooling device, a coolant bypass circuit, and a controller. The controller is configured to generate a control signal indicative of a desired flow of coolant through the coolant bypass circuit as a function of the projected rate of change in the cooling device temperature gradient.

20 Claims, 4 Drawing Sheets

COOLANT FLOW CONTROL SYSTEM AND METHOD

TECHNICAL FIELD

The present disclosure relates generally to a system and method for controlling coolant flow to a fluid cooling device. Specifically, the present invention relates to controlling coolant flow through an engine aftercooler.

BACKGROUND

As engine emissions requirements become stricter and horsepower ratings increase, aftercoolers on internal combustion engines are required to reject increased heat. The increased heat rejection and a high level of transient operation may cause thermal stress in the aftercoolers. When an engine is operated at a high load for any extended period of time, the aftercooler eventually reaches a steady state thermal condition characterized by a substantially constant temperature gradient through the depth of the aftercooler core. This temperature gradient, combined with the differences in Coefficient of Thermal Expansion (CTE) of the various materials within the core, induces stresses in the core. Changes in engine power and charge-air flow interrupt this balance resulting in a new temperature gradient and a new distribution of stress. A rapid change of the temperature within the core as the core adjusts to the new thermal conditions drives large changes in stress. An increased rate and magnitude of these thermal shock cycles may decrease the life of the aftercooler.

Reducing the overall temperature in which the aftercooler must work is effective in reducing stresses, but may negatively impact engine performance, or result in an increase in aftercooler size. Aftercoolers may also be produced with materials capable of withstanding the stresses inherent in their operation. While higher strength constituent materials are available, many aftercoolers have copper as one of their prime constituents due to its superior heat transfer properties. Many aftercoolers are assembled with a brazing process, a factor that compounds Copper's low mechanical strength. These braze joints are difficult to produce consistently and their fatigue characteristics (or behavior) are difficult to predict. Designing aftercoolers with the proper constraints such that changes in temperature and the corresponding thermal expansion do not set up resulting stresses may also be costly.

Aftercooler bypass circuits and flow control valves are known to those skilled in the art as a means to control the intake manifold air temperature for increased engine performance or reduced engine emissions, while providing the proper level of cooling for the engine block. For example, U.S. Pat. No. 4,697,551 to Larsen, et al, discloses a system with a proportional radiator shuttle valve to allow all or some of the engine coolant to flow through the radiator or alternatively through a radiator bypass flow conduit to the aftercooler. A quick-acting proportional aftercooler shuttle valve can allow mixing of cool coolant from the radiator which bypasses the aftercooler with coolant through the aftercooler.

SUMMARY

In one aspect of the disclosure a coolant flow control system is described. The coolant flow control system includes a fluid cooling device, a coolant bypass circuit, and a controller. The fluid cooling device includes a temperature gradient. The controller is configured to generate a control signal indicative of a desired flow of coolant through the coolant bypass circuit as a function of a projected rate of change in the temperature gradient.

In another aspect of the disclosure, an alternative embodiment a coolant flow control system is described. The alternative embodiment of the coolant flow control system includes a fluid cooling device, a coolant bypass circuit, a coolant bypass valve, an engine, an engine speed sensor, In another aspect of the present disclosure, a system to control the coolant flow through an aftercooler on an engine is described. The system includes an engine speed sensor, an air temperature sensor, a first coolant temperature sensor, a second coolant temperature sensor, and a controller. The controller is adapted to receive signals from the engine speed sensor, the air temperature sensor, the first coolant temperature sensor, and the second coolant temperature sensor, and generate a signal indicative of the desired position of the bypass valve as a function of the signals.

In another aspect of the present disclosure, a second alternative embodiment of a method to control coolant flow through an aftercooler with a coolant bypass valve on an engine is described. The method includes determining the current surface temperature at one or more locations on the aftercooler and determining the surface temperature at one or more previous times of at least one of the one or more locations on the aftercooler. The desired position of the coolant bypass valve is determined as a function of the current surface temperature at one or more locations on the aftercooler and the surface temperature at one or more previous times of at least one of the one or more locations on the aftercooler.

In another aspect of the present disclosure, an alternative embodiment of a system to control the coolant flow through an aftercooler on an engine is described. The system includes a bypass valve, at least one aftercooler surface temperature sensor and a controller. The controller includes a memory component. Previous aftercooler surface temperatures are stored in the memory component. The controller is adapted receive a signal from the at least one aftercooler sensor and to generate a signal indicative of a desired bypass valve position as a function of the signal and previous surface temperatures stored in the memory component.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

Figure 1:
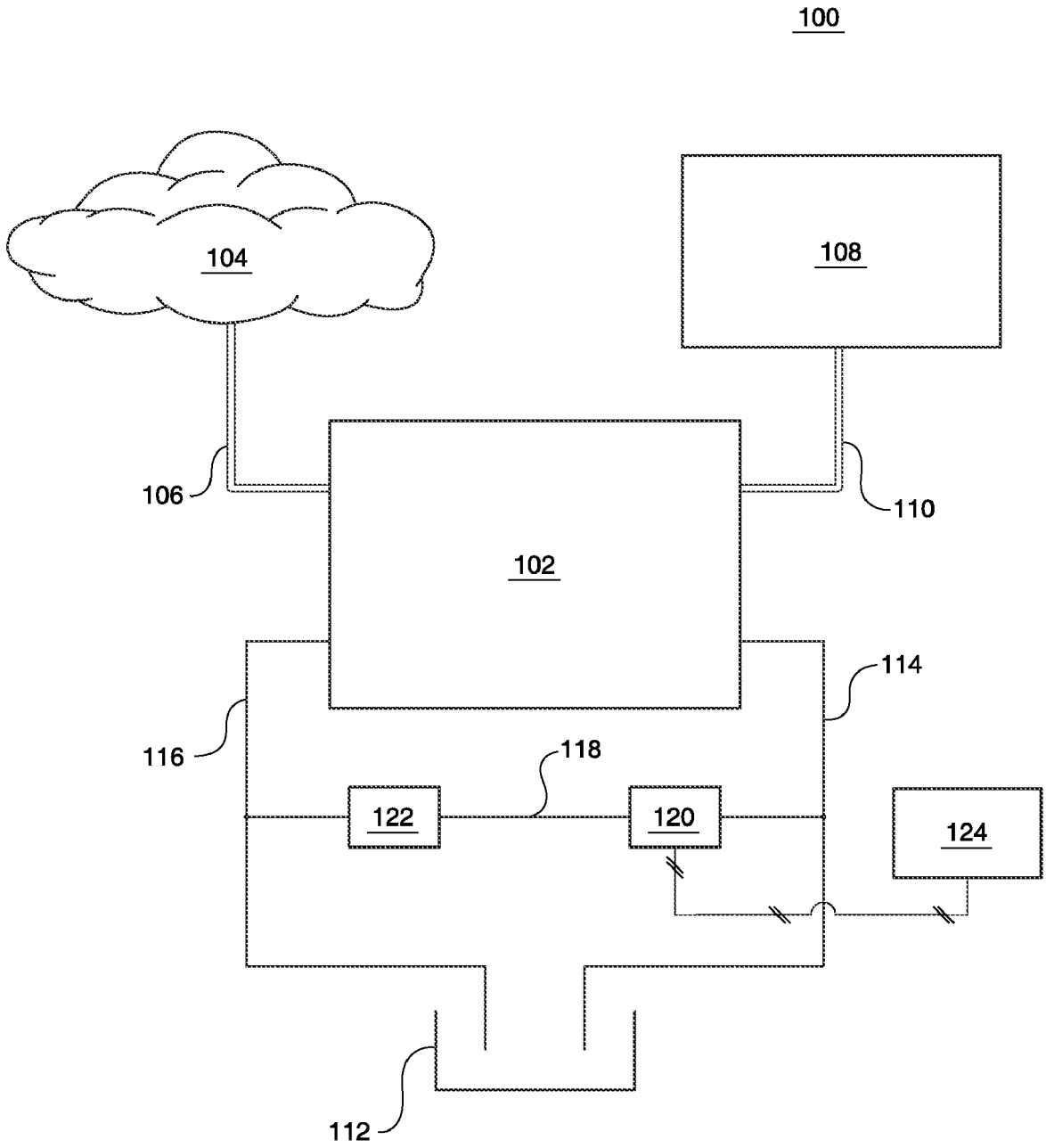
FIG. 1 is a schematic illustration of an exemplary embodiment of a coolant flow control system.

FIG. 1 illustrates an exemplary embodiment of a coolant flow control system 100. The coolant flow control system 100 may include a cooling device 102, a fluid source 104, a fluid intake conduit 106, a fluid destination 108, a fluid exit conduit 110, a coolant source 112, a coolant input conduit 114, a coolant output conduit 116, a coolant bypass circuit 118, and a controller 124.

Fluid (not shown) may flow from the fluid source 104, through the intake conduit 106 to the cooling device 102, through the cooling device 102 to the exit conduit 110, and through the exit conduit 110 to the fluid destination 108. Coolant (not shown) may flow from the coolant source 112, through the input conduit 114 to the cooling device 102, through the cooling device 102 to the output conduit 116, and through the output conduit 110 to the coolant source 112. Heat may be transferred from the fluid to the coolant while the fluid and the coolant flow through the cooling device 102 as would be known to a person skilled in the art now and in the future.

Fluid may include any substance that is able to flow. Intake fluid may include matter in a liquid state, matter in a gas state, and matter in a vapor state. Intake fluid may include for example atmospheric air, a water based mixture, and oils.

Coolant may include any substance that is able to flow and change state. Coolant may include matter in a liquid state, matter in a gas state, and matter in a vapor state. Coolant may include for example atmospheric air, a water based mixture, and oils.

The cooling device 102 may include any device through which the coolant and the fluid flow, and in which heat is transferred from the fluid to the coolant. Cooling devices may include but are not limited to aftercoolers, radiators, oil coolers, and air coolers. The cooling device 102 includes a temperature gradient (not shown). The temperature gradient of the cooling device 102 may include the rate of change in temperature of portions, areas and components of the cooling device 102 in relation to displacement from a given reference point. The temperature gradient may be three-dimensional. It is desirable to have minimal or no changes in the temperature gradient, and that any changes in the temperature gradient occur gradually. In mathematical terms the temperature gradient may be defined by the equation:

$$\nabla T = \left(\frac{\partial T}{\partial x}, \frac{\partial T}{\partial y}, \frac{\partial T}{\partial z}\right) \quad \text{(Eq. 1)}$$

Where T is temperature, and x, y, and z are three dimensional space coordinates of the cooling device 102. Changes in the temperature gradient will be minimal or non-existent if the change in temperature in relation to location is minimal or non-existent.

In one embodiment, a change in the temperature gradient may be projected through monitoring the surface temperature of the cooling device 102. In an alternative embodiment a change in the temperature gradient may be projected by monitoring the temperature of the coolant entering the cooling device 102, the coolant exiting the cooling device 102, the fluid entering the cooling device 102, and the fluid exiting the cooling device 102. Other methods known to a person skilled in the art now or in the future may also be used to project a change in the temperature gradient. Methods of controlling changes in the temperature gradient may include controlling the flow of coolant through the cooling device 102.

The fluid source 104 may include the atmosphere 204. In this embodiment the fluid includes air from the atmosphere. The air may be compressed before flowing into the cooling device 102. Other embodiments may include tanks, or other sources of the fluid as would be known by one skilled in the art now or in the future.

The intake conduit 106 may include any natural or artificial channel through which fluid is conveyed from the fluid source 104 to the cooling device 102. The exit conduit 110 may include any natural or artificial channel through which fluid is conveyed from the cooling device 102 to the fluid destination 108. The input conduit 114 may include any natural or artificial channel through which coolant is conveyed from the coolant source 112 to the cooling device 102. The output conduit 116 may include any natural or artificial channel through which fluid is conveyed from the cooling device 102 to the coolant source 112. Conduits may include a pipe, an air duct, flexible tubing, and any other device or combination of devices that would be known by a person skilled in the art now or in the future.

The fluid destination 108 may include any location the fluid flows to after flowing through the cooling device 102. The fluid may be cooler after flowing through the cooling device 102, and the fluid destination 108 may include a machine or a part of a machine. For example, the fluid destination 108 may include a machine air system, a machine hydraulic system, an engine air system, an engine oil system, an engine coolant system, and an engine combustion system. In one embodiment, the fluid destination 108 may include the air intake manifold of an internal combustion engine.

The coolant source 112 may include any location of a supply of coolant. For example, the coolant source 112 may include a coolant supply tank on an engine 208 or a machine. In another embodiment the coolant source 112 may include the coolant system through which coolant circulates on an engine 208 or a machine. In still another embodiment the coolant source 112 may include atmospheric air or an alternative supply of air. The coolant source 112 may include any source of the coolant which flows through the cooling device 102 that would be known by a person skilled in the art now or in the future.

In the depicted embodiment, the coolant returns to the coolant source 112 after flowing through the cooling device 102. In alternative embodiments, the coolant may flow to a destination other than the coolant source 112 after flowing through the cooling device 102.

The coolant bypass circuit 118 may include any physical interconnection of elements through which the coolant may flow. The bypass circuit 118 may permit a portion the coolant to flow around the cooling device 102, decreasing the volume of coolant flowing through the cooling device 102.

The coolant bypass circuit 118 may include a bypass valve 120, and a check valve 122. The bypass valve 120 may control the flow of fluid which flows through the bypass circuit 118 and the cooling device 102. The bypass valve 120 may include a variable position bypass valve. In an alternative embodiment the bypass valve 120 may include an open/close position valve. The check valve 122 may include any device which allows coolant to flow in only one direction. The check valve 122 may be positioned in the bypass circuit 118 such that coolant may flow into the bypass circuit 118 and around the cooling device 102, but is unable to flow in the opposite direction.

The controller 124 may include a processor (not shown) and a memory component (not shown). The processor may be microprocessors or other processors as known in the art. In some embodiments the processor may be made up of multiple processors. The processor may execute instructions for control of the bypass circuit 118, such as the methods described below in connection with FIGS. 3 and 4. Such instructions may be read into or incorporated into a computer readable medium, such as the memory component or provided external to processor. In alternative embodiments, hard-wired circuitry may be used in place of or in combination with software instructions to implement a steering method. Thus embodiments are not limited to any specific combination of hardware circuitry and software.

The term "computer-readable medium" as used herein refers to any medium or combination of media that participates in providing instructions to processor for execution. Such a medium may take many forms, including but not limited to, non-volatile media, volatile media, and transmission media. Non-volatile media includes, for example, optical or magnetic disks. Volatile media includes dynamic memory. Transmission media includes coaxial cables, copper wire and fiber optics, and can also take the form of acoustic or light waves, such as those generated during radio-wave and infrared data communications.

Common forms of computer-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, and EPROM, a FLASH-EPROM, any other memory chip or cartridge, a carrier wave as described hereinafter, or any other medium from which a computer or processor can read.

The memory component may include any form of computer-readable media as described above. The memory component may include multiple memory components.

In the illustrated embodiment, the controller 124 is enclosed in a single housing. In an alternative embodiment, the controller 124 may include a plurality of components operably connected and enclosed in a plurality of housings. The controller 124 may be located on-board an engine 208 (depicted in FIG. 2). In another embodiment, the controller 124 may be located on-board a vehicle (not shown). In still other embodiments the controller may be located in a plurality of operably connected locations including on-board an engine 208, on-board a vehicle, and remotely.

The controller 124 may be configured to generate a control signal indicative of a desired flow of coolant through the coolant bypass circuit 118 as a function of a projected rate of change in the temperature gradient. In one embodiment, the control signal may include a signal indicative of a desirable position of the bypass valve 120. In other embodiments the control signal may be indicative of any parameter which would indicate a desired flow of coolant through the bypass circuit 118 known by a person skilled in the art now or in the future. The controller 124 may be operably coupled to the bypass valve 120 to deliver a control signal to the bypass valve 120.

Figure 2:
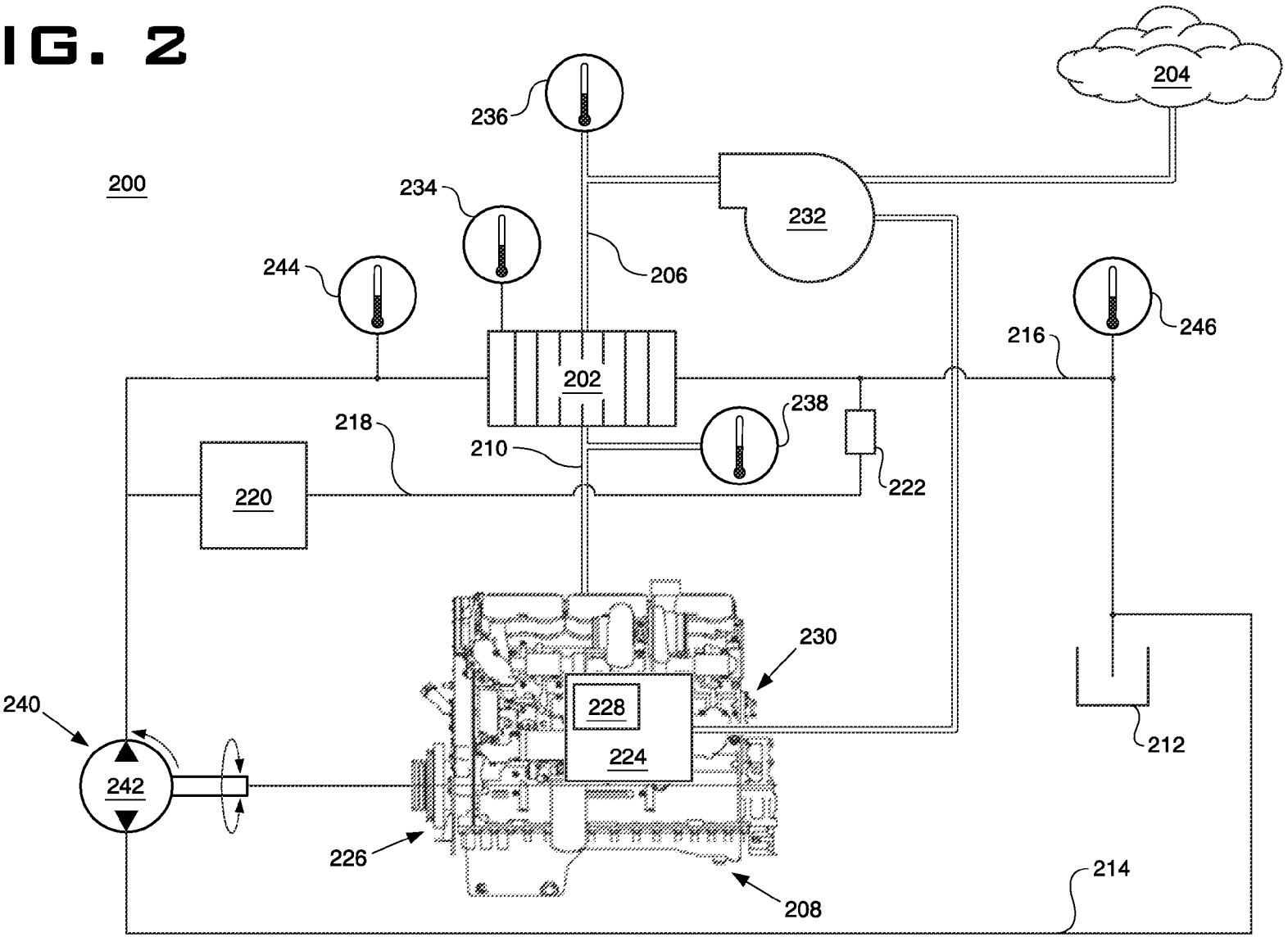
FIG. 2 is a schematic illustration of an alternative exemplary embodiment of a coolant flow control system.

FIG. 2 illustrates an alternative exemplary embodiment of a coolant flow control system 200. The coolant flow control system 200 may include an aftercooler 202, an intake air duct 206, an engine 208, an exit air duct 210, a coolant tank 212, an aftercooler supply line 214, an aftercooler discharge line 216, an aftercooler bypass circuit 218, a controller 224, an air compressor 232 and a temperature gradient change projection system. Although not shown as distinct element in FIG. 2, elements of the temperature gradient change projection system are shown and will be described further below.

Air from an atmosphere 204 may flow through the intake air duct 206 and the air compressor 232 to the aftercooler 202. The air may flow through the aftercooler 202 to the exit air duct 210. The air may flow through the exit air duct 210 to an intake air manifold of the engine 208. Coolant from the coolant tank 212 may flow through the aftercooler supply line 214 to the aftercooler 202. The coolant may flow through the aftercooler 202 into the aftercooler discharge line 214. The coolant may flow through the aftercooler discharge line 214 to the coolant tank 212. Heat may be transferred from the air to the coolant while the air and the coolant flow through the aftercooler 202.

The aftercooler 202 may include any device which provides an air-to-liquid heat exchanger operable to cool the air flowing from the atmosphere, through the air compressor 232, and through the intake air duct 206. The aftercooler 202 may include one or more materials with different Coefficients of Thermal Expansion. The aftercooler 202 may include a temperature gradient. A temperature gradient change projection system, described in greater detail below, may project a change in the temperature gradient.

The intake air duct 206 may operably connect the atmosphere 204 to the aftercooler 202 such that air flows from the atmosphere to the aftercooler 202. The intake air duct 206 may include any pipe, tube, or passage through which a fluid, including a gas, may be conveyed from the atmosphere 204 to the aftercooler 202 that would be known to one skilled in the art now or in the future. The intake air duct 206 may include metallic tubing and an air compressor 232.

The air compressor 232 may include a turbine. The turbine may include a turbocharger powered by the flow of exhaust gases from the engine 208. In an alternative embodiment the turbine may be powered by mechanical or electrical energy from the engine 208 or another power source. Examples include turbines powered by gears or belts driven by the engine 208, and turbines powered by one or more electrical motors. The air compressor may include any device which compresses air known to one skilled in the art now or in the future. The intake air duct 206 may include more than one air compressor 232.

The exit air duct 210 may operably connect the aftercooler 202 to the engine 208 such that air flows from the aftercooler 202 to the engine 208. The exit air duct 210 may include any pipe, tube, or passage through which a fluid, including a gas, may be conveyed from the aftercooler 202 to the engine 208 that would be known to one skilled in the art now or in the future. The exit air duct 210 may include metallic tubing. Air may flow through the exit air duct 210 to the intake manifold of the engine 208.

The engine 208 may be an internal combustion engine or any type power source that requires an air supply to operate known to one skilled in the art now or in the future.

The coolant tank 212 may include any receptacle known by one skilled in the art now or in the future operable to hold fluids. The coolant tank 212 may be physically attached to the engine 208, or may be an integral part of the engine 208. In another embodiment the coolant tank 212 may be located remotely from the engine 208. The coolant tank 212 may be operably connected to the aftercooler 202 such that coolant from the coolant tank 212 may flow to and through the aftercooler 202. In one embodiment, the coolant tank 212 may also be operably connected to the engine 208 such that coolant from the coolant tank 212 flows to and through the engine 208.

The aftercooler supply line 214 may operably connect the coolant tank 212 to the aftercooler 202. The aftercooler supply line 214 may include any conduit, channel, or pipe operable to convey fluids known to one skilled in the art now or in the future.

The aftercooler supply line may include a coolant pump 240. The coolant pump 240 may include any device or machine for transferring a gas or liquid from a source or container through tubes or pipes to another container or receiver. The coolant pump 240 may be operable to pump coolant from the coolant tank 212 through the aftercooler supply line 214 to the aftercooler 202. The coolant pump may be operable to pump coolant from the coolant tank 212 through the aftercooler bypass circuit 218. The coolant pump 240 may include a SCAC coolant pump 242 (separate circuit aftercooler coolant pump). The coolant pump 240 may be geared or belt driven by the engine 208 and the rate of coolant pumped by the coolant pump 240 may be a direct function of engine 208 speed. In an alternative embodiment, the coolant pump 240 may include a variable output pump. For example the coolant pump 240 may include a variable displacement pump with an adjustable swashplate. In another embodiment the coolant pump 240 may include a pump driven by an power source such as an electric motor wherein the rate of coolant pumped by the coolant pump 240 is independent of engine 208 speed.

The aftercooler discharge line 216 may operably connect the aftercooler 202 to the coolant tank 212 such that coolant flows from the aftercooler 202 and discharges into the coolant tank 212. The aftercooler discharge line 216 may include any conduit, channel, or pipe operable to convey fluids known to one skilled in the art now or in the future.

The aftercooler bypass circuit 218 may be operable to selectively allow coolant to flow from the aftercooler supply line 214 to the coolant tank 212 without flowing through the aftercooler 202. The aftercooler bypass circuit 218 may allow a portion of the coolant flowing through the aftercooler supply line 214 to flow to the coolant tank 212 without flowing through the aftercooler 202, or alternatively the aftercooler bypass circuit 218 may allow all of the coolant flowing through the aftercooler supply line 214 to flow to the coolant tank 212 without flowing through the aftercooler 202. The aftercooler bypass circuit 218 may include any conduit, channel, or pipe operable to convey fluids known to one skilled in the art now or in the future.

The aftercooler bypass circuit 218 may include a bypass valve 220. The bypass valve 220 may include any valve operable to control the flow of fluid through the aftercooler bypass circuit 218 and the aftercooler 202 known to one skilled in the art now or in the future. In one embodiment the bypass valve 220 may include a variable position electronically actuated valve operably to vary the size of an orifice the coolant must flow through to enter the aftercooler bypass circuit 218. In an alternative embodiment the bypass valve 220 may be mechanically or hydraulically actuated. In another embodiment the bypass valve 220 may include a valve with two positions, open and close. The bypass valve 220 may be operably coupled to the controller 224 to receive a bypass valve actuation signal indicative of a desired bypass valve position. The bypass valve 220 may be configured to generate a signal indicative of the valve position.

The check valve 222 may be operable to prevent coolant entering the aftercooler bypass circuit 218 from the aftercooler supply line 214 from flowing back into the aftercooler supply line 214 and then through the aftercooler. The check valve 222 may include any device for limiting flow in a piping system to a single direction known by one skilled in the art now and in the future.

The controller 224 may include one or more housings operably connected. The housings may be located on the engine 208, remotely from the engine 208, or both on the engine 208 and remotely. The controller 224 may include instructions in the memory component to generate a control signal indicative of a desired flow of coolant through the aftercooler bypass circuit 218 as a function of a projected rate of change of the temperature gradient. The controller 224 may be operable to implement the methods described in relation to FIG. 3 and FIG. 4.

The temperature gradient change projection system may include one or more of an engine speed sensor 226, an engine load sensor 228, an intake air temperature sensor 236, an exit air temperature sensor 238, an input coolant temperature sensor 244, an output coolant temperature sensor 246, and the controller 224.

The engine speed sensor 226 may be configured to generate an engine speed signal indicative of the rotational speed of the crankshaft or flywheel on the engine 208. The engine speed sensor 226 may include any device known by one skilled in the art now or in the future that will generate a signal indicative of the rotational speed of the engine 208 crankshaft or flywheel.

The engine load sensor 228 may be configured to generate a signal indicative of the engine 208 load. The engine load sensor 228 may include a virtual sensor. The virtual sensor may include a device or combination of devices that may estimate the engine load using mathematical models in conjunction with physical sensors. For example, the virtual sensor may include a fuel flow sensor 230 configured to generate a signal indicative of the fuel flow in the engine 208, the engine speed sensor 226, and the controller 224. The controller 224 may be configured to determine the engine 208 load as a function of the fuel flow signal and the engine speed signal. In another embodiment the virtual sensor may estimate engine 208 load as a function of other signals from other sensors. In still other embodiments the engine load sensor 228 may directly measure engine 208 load through a physical property of the engine 208. For example, when the engine 208 is connected to a driveline, strain gauges may be attached to the driveshaft to directly measure torque. The controller 224 may calculate engine 208 load as a function of the driveline torque measurement and engine 208 parasitics. Another non-limiting example of engine load sensor 228, may include an engine 208 connected to and driving an electric generator. A voltage sensor and a current sensor may measure the electrical power being produced by the generator. The controller 224 may calculate engine 208 load as a function of the generator voltage, the generator current, engine 208 parasitics, and mechanical power losses between the engine 208 and the generator. The engine load sensor 228 may include any device or combination of devices known by one skilled in the art now or in the future that may generate a signal indicative of engine 208 load.

The intake air temperature sensor 236 may include any device configured to generate an intake air temperature signal indicative of the temperature of the air entering the aftercooler 202 after exiting the air compressor 232 known by one skilled in the art now or in the future.

The exit air temperature sensor 238 may include any device configured to generate an exit air temperature signal indicative of the temperature of the air exiting the aftercooler 202 before entering the engine 218 known by one skilled in the art now or in the future.

The input coolant temperature sensor 244 may include any device configured to generate an input coolant temperature signal indicative of the temperature of the coolant entering the aftercooler 202 known by one skilled in the art now or in the future.

The output coolant temperature sensor 246 may include any device configured to generate an output coolant temperature signal indicative of the temperature of the coolant exiting the aftercooler 202 known by one skilled in the art now or in the future.

The controller 224 may be operably coupled to the engine speed sensor 226 to receive the engine speed signal. The controller 224 may be operably coupled to the engine load sensor 228 to receive the engine load signal. The controller 224 may be operably coupled to the intake air temperature sensor 236 to receive the intake air temperature signal. The controller 224 may be operably coupled to the exit air temperature sensor 238 to receive the exit air temperature signal. The controller 224 may be operably coupled to the input coolant temperature sensor 244 to receive the input coolant temperature signal. The controller 224 may be operably coupled to the output coolant temperature sensor 246 to receive the output coolant temperature signal. The controller 224 may be configured to project a change in the temperature gradient as a function of the engine speed signal, the engine load signal, the intake air temperature signal, the exit air temperature signal, the input coolant temperature signal, and the output coolant temperature signal, as described below in relation to FIG. 3.

In an alternative embodiment, the temperature gradient change projection system may include aftercooler temperature sensors 234, and the controller 224. Aftercooler temperature sensors 234 may include multiple sensors configured to generate multiple signals indicative of the temperature at multiple locations on the aftercooler 202 surface. The controller 224 may be configured to receive the temperature signals. The controller 224 may be configured to project a change in the temperature gradient as a function of the temperature signals, as described below in relation to FIG. 4.

INDUSTRIAL APPLICABILITY

When the temperatures of the coolant and fluid flowing through the cooling device 102 rise and fall rapidly, the cooling device 102 may be subject to thermal stress cycles which cause material fatigue and reduce functional life. For example, when an engine 208 is operated at high load for an extended period of time, the aftercooler 202 may reach a steady state thermal condition characterized by a substantially constant temperature gradient through the depth of the aftercooler 202 core. When the engine 208 load fluctuates rapidly, the aftercooler 202 may be subject to thermal stress cycles due to rapid changes in the temperature gradient and differences in the Coefficient of Thermal Expansion of the various materials in the aftercooler 202 core. The coolant control flow method 300 may reduce these stress cycles by reducing changes in the temperature gradient, and thus extend aftercooler 202 life.

Figure 3:
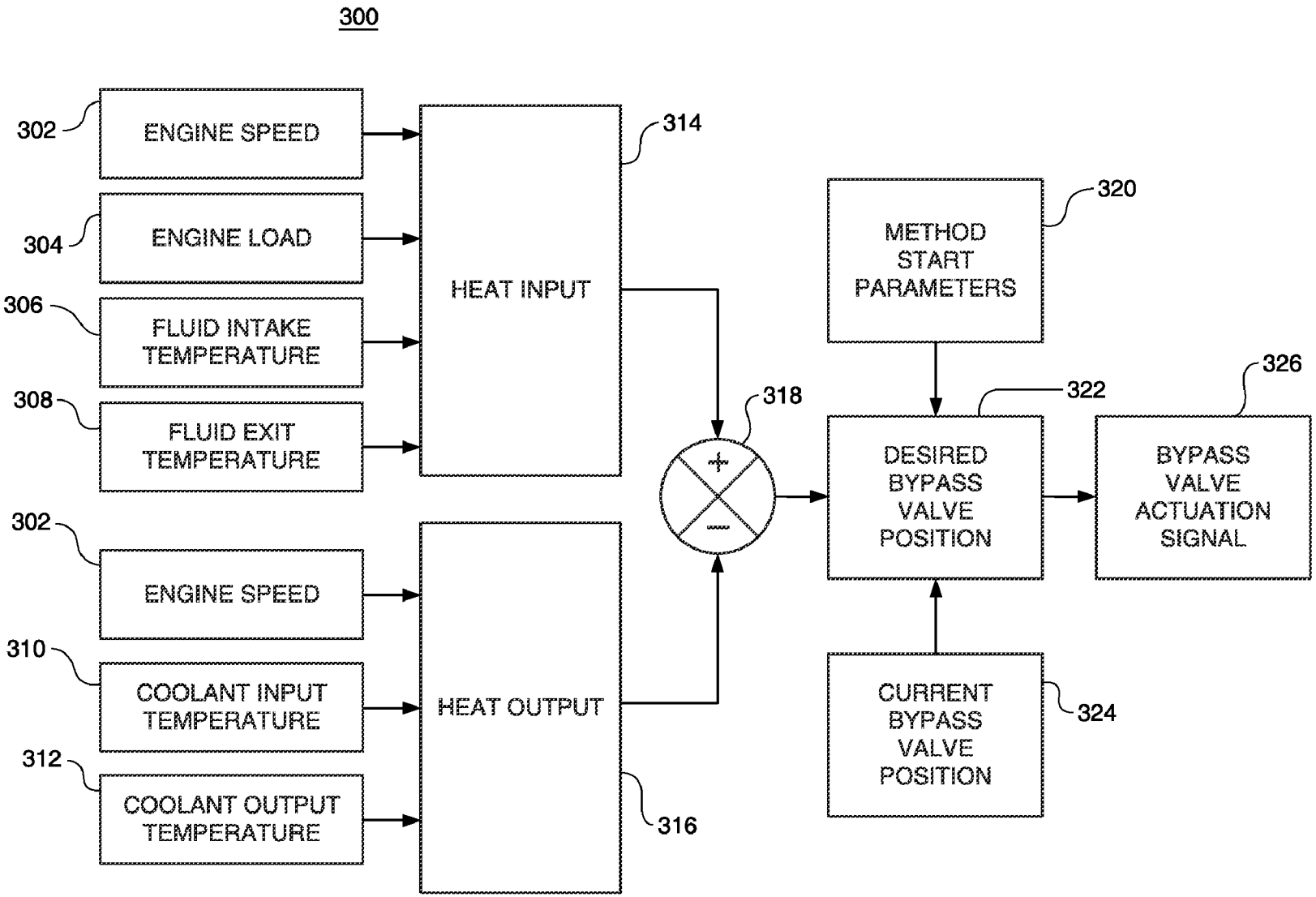
FIG. 3 is a flow chart of an exemplary coolant flow control method.

Referring now to FIG. 3, a coolant flow control method 300 is depicted. A rate of change in the temperature gradient of the aftercooler 202 may be projected by calculating the difference 318 between an estimated heat input 314 to the aftercooler 202 and an estimated heat output 316 from the aftercooler 202. The controller 224 may calculate the difference 318 and generate a bypass valve actuation signal 326 to control the flow of coolant through the aftercooler bypass circuit 218.

The heat input 314 to the aftercooler 202 may include the amount of heat energy that is transferred from the air as it flows through the aftercooler 202. The amount of heat energy transferred from the air as it flows through the aftercooler 202 may be estimated as a function of the flow rate of the air as it enters the aftercooler 202, the intake air temperature signal 306, and the exit air temperature signal 308.

In an embodiment where the air compressor 232 is a turbocharger, powered by exhaust gas flow from the engine 208, the flow rate of air as it enters the aftercooler 202 may be estimated as a function of engine speed 302 and engine load 304. The controller 224 may estimate the flow rate of air entering the aftercooler 202 as a function of the engine speed signal 302, the engine load signal 304, and experimental data stored in the memory component. In an alternative embodiment the controller 224 may estimate the flow rate of air entering the aftercooler 202 as a function of the engine speed signal 302; the engine load 304; and geometrical, structural, and functional data on the intake air duct 206 stored in the memory component.

In alternative embodiments where the air compressor 232 may have an alternative power source, such as an electric motor or mechanical gearing to the engine, other factors such as current into the motor or motor speed may be used to calculate the flow rate of air into the aftercooler 202.

In another alternative embodiment an air pressure sensor may be located in the intake air duct 206 configured to generate an air intake pressure signal indicative of the air pressure as the air flows into the aftercooler 202. The controller may be configured to calculate the flow rate of the air as it enters the aftercooler 202 as a function of the air intake pressure signal.

The heat output 316 from the aftercooler 202 may include the amount of heat energy that is transferred to the coolant as it flows through the aftercooler 202. The amount of heat energy transferred to the coolant as it flows through the aftercooler 202 may be estimated as a function of the flow rate of the coolant as it enters the aftercooler 202, the input coolant temperature signal 310, and the output coolant temperature signal 312.

In an embodiment where the coolant pump 242 is a constant displacement pump, and the pump speed is directly related to engine speed 302 (such as a pump geared or belt driven by the engine 208), the flow rate of coolant as it enters the aftercooler 202 may be estimated as a function of engine speed 302. The controller 224 may estimate the flow rate of coolant entering the aftercooler 202 as a function of the engine speed signal 302, and experimental data stored in the memory component. In an alternative embodiment the controller 224 may estimate the flow rate of coolant entering the aftercooler 202 as a function of the engine speed signal 302; and geometrical, structural, and functional data on the aftercooler supply line 214 stored in the memory component.

In alternative embodiments where the coolant pump 242 has a variable displacement other factors such as the swashplate angle may be used to calculate the flow rate of coolant into the aftercooler 202.

In embodiments where the coolant pump 242 speed is not dependent on the engine speed 302, another method of calculating pump speed or pump output may be used.

In another alternative embodiment a coolant pressure sensor may be located in the aftercooler supply line 214 configured to generate an coolant input pressure signal indicative of the coolant pressure as the coolant flows into the aftercooler 202. The controller may be configured to calculate the flow rate of the coolant as it enters the aftercooler 202 as a function of the coolant input pressure signal.

The controller 224 may be configured to determine a desired flow of coolant through the aftercooler bypass circuit 318 as a function of the difference 318 between the heat input 314 and the heat output, and method start parameters 320. The controller 224 may be configured to generate a control signal indicative of the desired flow of coolant through the aftercooler bypass circuit 318. The control signal may include a bypass valve actuation signal 326. The controller 224 may be configured to generate the bypass valve actuation signal 326 as a function of a desired bypass valve position 322 and the current bypass valve position 324. The desired bypass valve position 322 may be a function of the difference 318 and method start parameters 320. The desired bypass valve position 322 may be indicative of a desired flow of coolant through the aftercooler bypass circuit 318.

Method start parameters 320 may include any parameters that indicate the engine 208 has reached a steady state operation level. In an alternative embodiment method start parameters may include other desirable states of operation. The controller 224 may determine that the engine 208 has reached a steady state or some other desirable state of operation such that it is desirable to limit the rate of change of the temperature gradient. The controller 224 may determine that the engine 208 has reached a steady or other desirable state by any method known to one skilled in the art now or in the future.

Figure 4:
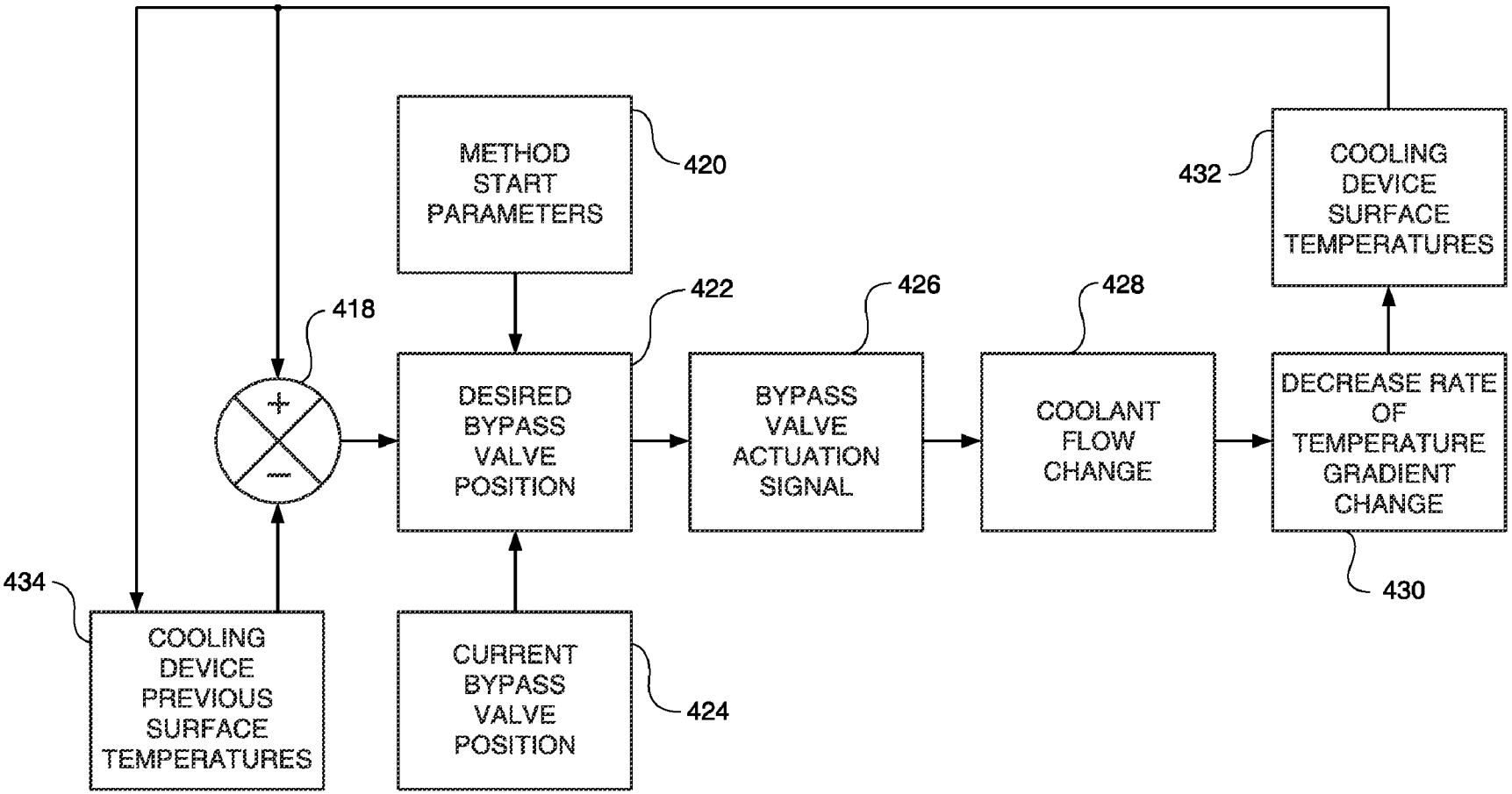
FIG. 4 is a flow chart of an exemplary coolant flow control method.

Referring now to FIG. 4, an alternative embodiment of the coolant flow control method 400 is depicted. A projected rate of change of the temperature gradient may be a function of cooling device surface temperatures 432 and previous cooling device surface temperatures 434.

The controller 124 may be configured to receive temperature signals indicative of the cooling device surface temperatures 432. In the embodiment depicted in FIG. 2, the signals may include the temperature signals generated by the aftercooler temperature sensors 234.

The controller 124 may receive the temperature signals at intervals and may store previous temperature signals in the memory component. The previous temperature signals may be indicative of cooling device previous surface temperatures 434.

A projected rate of change of the temperature gradient may be a function of the difference 418 between cooling device surface temperatures 432 and cooling device previous surface temperatures 434. The controller 124 may be configured calculate the difference 418 as a function of the cooling device surface temperatures 432 and the previous cooling device surface temperatures 434.

A desired flow of coolant through the coolant bypass circuit 118 may be determined as a function of the difference 418. The desired flow of coolant through the coolant bypass circuit 118 may be indicative of a desired bypass valve position 422. The controller 124 may be configured to determine the desired bypass valve position 422 as a function of the difference 418 and method start parameters 420.

The controller 124 may be configured to generate a control signal indicative of the desired flow of coolant through the coolant bypass circuit 118 as a function of the desired bypass valve position 422 and the current bypass valve position 424. The control signal indicative of the desired flow of coolant through the coolant bypass circuit 118 may include a bypass valve actuation signal 426.

The bypass valve actuation signal 426 may actuate the bypass valve 120. The actuation of the bypass valve 120 may generate a coolant flow change 428 through the coolant bypass circuit 118. The coolant flow change 428 may generate a decrease in the rate of temperature gradient change 430.

From the foregoing it will be appreciated that, although specific embodiments have been described herein for purposes of illustration, various modifications or variations may be made without deviating from the spirit or scope of inventive features claimed herein. Other embodiments will be apparent to those skilled in the art from consideration of the specification and figures and practice of the arrangements disclosed herein. It is intended that the specification and disclosed examples be considered as exemplary only, with a true inventive scope and spirit being indicated by the following claims and their equivalents.

What is claimed is:

1. A coolant flow control system, comprising:

a fluid cooling device, the fluid cooling device having a temperature gradient comprising a rate of change in temperature through a core of the fluid cooling device in relation to a displacement from a given reference point, a first temperature sensor configured to monitor a first heat energy parameter associated with the temperature gradient of the cooling device and generate a first heat energy signal, a coolant bypass circuit, and a controller configured to:

determine a projected rate of change in the temperature gradient as a function of the heat energy signal, and generate a control signal indicative of a desired flow of coolant through the coolant bypass circuit as a function of the projected rate of change in the temperature gradient.

2. The coolant flow control system of claim 1, further comprising a coolant bypass valve, the bypass valve controlling the flow of coolant through the coolant bypass circuit, wherein the control signal is indicative of a desired position of the bypass valve.

3. The coolant flow control system of claim 1, in which the first heat energy parameter monitored by the first temperature sensor comprises a heat input parameter associated with the cooling device, and the first heat energy signal is indicative of a heat input to the cooling device, the system further comprising:

a second temperature sensor configured to monitor a heat output parameter associated with the cooling device and generate a second heat energy signal indicative of a heat output from the cooling device, wherein the controller is configured to generate a heat input to the fluid cooling device as a function of the first heat energy signal, a heat output to the fluid cooling device as a function of the second heat energy signal, and the control signal as a function of the heat input to the fluid cooling device and the heat output from the fluid cooling device.

4. The coolant flow control system of claim 3, further comprising:

an engine, an engine speed sensor configured to generate a speed signal indicative of the engine speed, and an engine load sensor configured to generate a load signal indicative of the engine load, and wherein the controller is configured to determine the heat input as a function of the first heat energy signal, the speed signal and the load signal.

5. The coolant flow control system of claim 4, wherein the controller is configured to determine the heat output as a function of the second heat energy signal and the speed signal.

6. The coolant flow control system of claim 4, wherein the fluid cooling device includes an aftercooler operable to cool engine intake air.

7. The coolant flow control system of claim 3, in which the first temperature sensor comprises an intake fluid temperature sensor, the heat input parameter comprises a temperature of fluid entering the fluid cooling device, and the first heat energy signal comprises an intake fluid temperature signal indicative of the temperature of fluid entering the fluid cooling device, the system further comprising:

an exit fluid temperature sensor configured to generate an exit fluid temperature signal indicative of a temperature of fluid exiting the fluid cooling device, and wherein the controller is configured to determine the heat input as a function of the intake fluid temperature signal and the exit fluid temperature signal.

8. The coolant flow control system of claim 3 in which the second temperature sensor comprises an input coolant temperature sensor, the heat output parameter comprises a temperature of coolant entering the fluid cooling device, and the second heat energy signal comprises an input coolant temperature signal indicative of the temperature of coolant entering the fluid cooling device, the system further comprising:

an output coolant temperature sensor configured to generate an output coolant temperature signal indicative of a temperature of coolant exiting the fluid cooling device, and wherein the controller is configured to determine the heat output as a function of the input coolant temperature signal and the output coolant temperature signal.

9. The coolant flow control system of claim 1, in which the first temperature sensor comprises a surface temperature sensor, the first heat energy parameter comprises a surface temperature of the cooling device, and the first heat energy signal comprises a first surface temperature signal indicative of the surface temperature of the cooling device, and wherein the controller is configured to generate the control signal as a function of a change in the first surface temperature signal.

10. The coolant flow control system of claim 9, further comprising a plurality of second temperature sensors configured to generate a plurality of second surface temperature signals indicative of surface temperatures at different locations on the fluid cooling device, and wherein the controller is configured to generate the control signal as a function of the first surface temperature signal and the plurality of second surface temperature signals.

11. A coolant flow control system, comprising:

a fluid cooling device, the fluid cooling device having a temperature gradient comprising a rate of change in temperature through a core of the fluid cooling device in relation to a displacement from a given reference point, a first temperature sensor configured to monitor a first heat energy parameter associated with the temperature gradient of the cooling device and generate a first heat energy signal, a coolant bypass circuit, and a controller configured to:

determine a projected rate of change in the temperature gradient as a function of the heat energy signal, and generate a control signal indicative of a desired flow of coolant through the fluid cooling device as a function of the projected rate of change in the temperature gradient.

12. A coolant flow control method, comprising:

providing a fluid cooling device, the fluid cooling device having a temperature gradient comprising a rate of change in temperature through a core of the fluid cooling device in relation to a displacement from a given reference point, determining a first heat energy parameter associated with the temperature gradient of the cooling device, determining a projected rate of change of the temperature gradient of the fluid cooling device as a function of the first heat energy parameter, and determining a desired flow of coolant through a coolant bypass circuit as a function of the projected rate of change of the temperature gradient.

13. The coolant flow control method of claim 12, further comprising determining a desired position of a coolant bypass valve as a function of the desired flow of coolant.

14. The coolant flow control method of claim 12, in which the first heat energy parameter comprises a heat input parameter associated with the cooling device, the method further comprising:

monitoring a heat output parameter associated with the cooling device, determining a heat input to the fluid cooling device as a function of the heat input parameter, determining a heat output from the fluid cooling device as a function of the heat output parameter, and determining the projected rate of change of the temperature gradient as a function of the heat input and the heat output.

15. The coolant flow control method of claim 12, in which the first heat energy parameter comprises a surface temperature of the cooling device, the method further comprising:

determining the projected rate of change of the temperature gradient as a function of the surface temperature of the cooling device.

16. The coolant flow control method of claim 14 further comprising:

determining an engine speed, and further determining at least one of the heat input and the heat output as a function of the engine speed.

17. The coolant flow control method of claim 14, further comprising:

determining an engine load, and further determining the heat input as a function of the engine load.

18. The coolant flow control method of claim 14, in which the heat input parameter comprises an intake fluid temperature of a fluid entering the fluid cooling device, the method further comprising:

determining an exit fluid temperature of the fluid exiting the fluid cooling device, and determining the heat input as a function of the intake fluid temperature and the exit fluid temperature.

19. The coolant flow control method of claim 14, in which the heat output parameter comprises an input coolant temperature of a coolant entering the fluid cooling device, the method further comprising:

determining an output coolant temperature of the coolant exiting the fluid cooling device, and determining the heat output as a function of the input coolant temperature and the output coolant temperature.

20. The coolant flow control method of claim 14, further comprising storing experimental data, and determining at least one of the heat input and the heat output as a function of the experimental data.

* * * * *